United States Patent [19]

Farley

[11] 4,440,218

[45] Apr. 3, 1984

[54] SLURRY UP PARTICULATE PLACEMENT TOOL

[75] Inventor: David L. Farley, Lafayette, La.

[73] Assignee: Completion Services, Inc., Lafayette, La.

[21] Appl. No.: 262,714

[22] Filed: May 11, 1981

[51] Int. Cl.[3] ..... E21B 43/04

[52] U.S. Cl. ..... 166/51; 166/133

[58] Field of Search ..... 166/51, 278, 133, 126, 166/128, 334

[56] References Cited

U.S. PATENT DOCUMENTS

| | | | |
|---|---|---|---|
| 2,207,334 | 7/1940 | Reynolds et al. | 166/51 X |
| 3,433,303 | 3/1969 | Clark, Jr. et al. | 166/184 |
| 3,710,862 | 1/1973 | Young et al. | 166/278 |
| 3,963,076 | 6/1976 | Winslow | 166/51 X |
| 3,987,854 | 10/1976 | Callihan et al. | 166/278 |

*Primary Examiner*—Ernest R. Purser
*Assistant Examiner*—Thuy M. Bui
*Attorney, Agent, or Firm*—Murray Robinson; Ned L. Conley; David A. Rose

[57] ABSTRACT

A sand or gravel placement or packing apparatus for positioning particulates outside well screen includes pipe to conduct slurry to below the screen and receive clear liquid returning from outside the screen as the particulates accumulate upwardly, the apparatus including valving to provide for initial injection of clear fluid, for circulation slurry, for squeezing the slurry, for flusing the tubing and parts of the tool by reverse circulation, and for closing the slurry injection part below the screen and the lower end of the slurry pipe when the latter is withdrawn.

31 Claims, 16 Drawing Figures

PRESSURE TESTING
AND INJECTING 21
61
63
25
23
33
35
27
31
29
37
53
51
59
47
57
41
69
71
65
67
61
79
77
63
81
83
55
131
SCREEN
VALVE
CLOSED
113
158
157
156
160
219
223
171
FOOT
VALVES
OPEN
187
179
177
31
29
CIRCULATING
VALVE CLOSED 69
71
153
INDEXING TOOL
CLOSED POSITION

CIRCULATING AND SQUEEZING GRAVEL PACK
Fig. 2
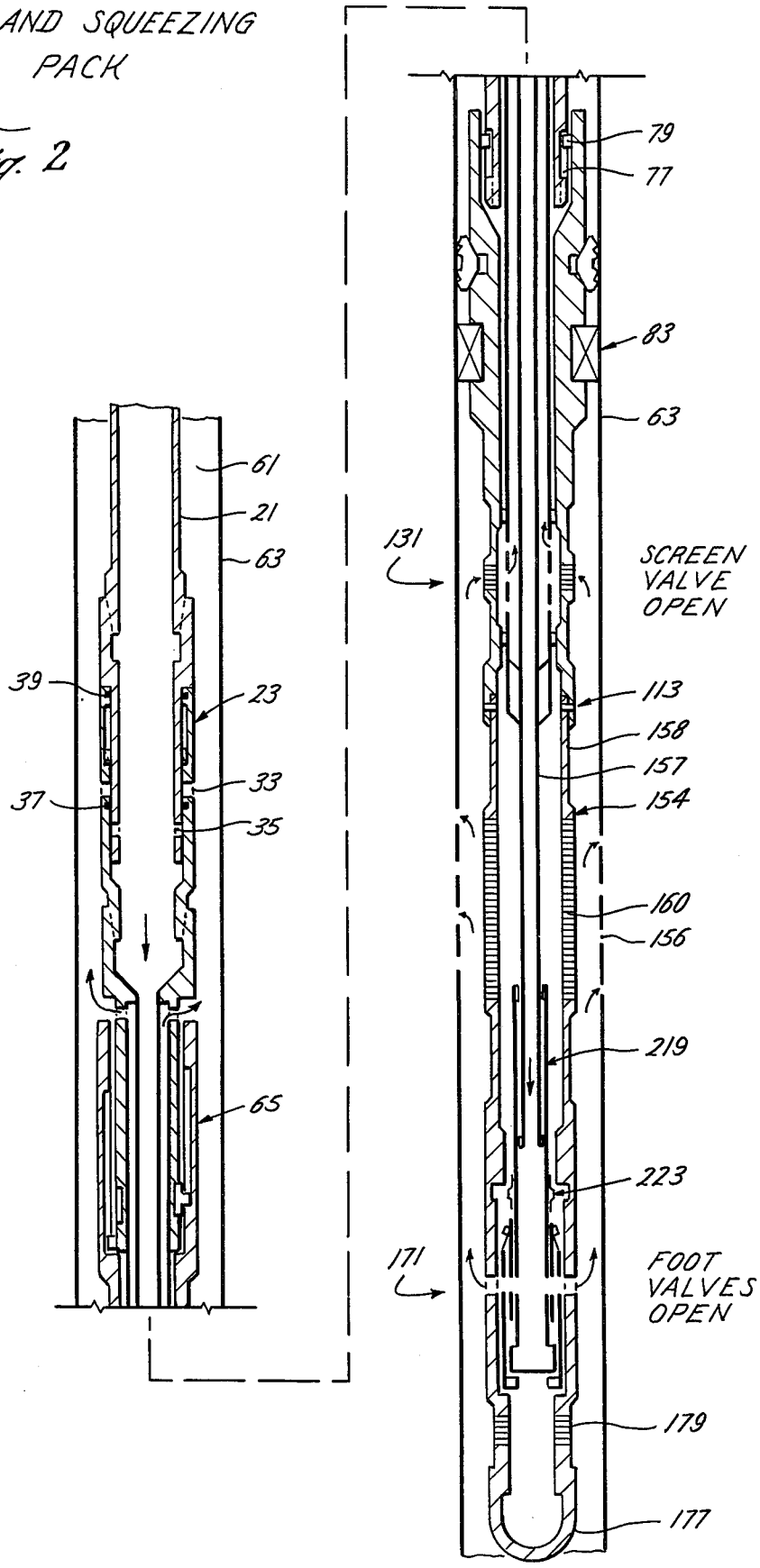
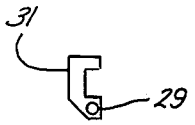
CIRCULATING VALVE CLOSED
Fig. 2A
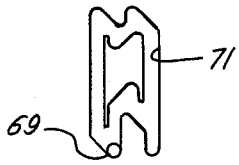
INDEXING TOOL OPEN POSITION
Fig. 2B

REVERSE CIRCULATING 21
79
81
83
63
29
31
39
23
33
35
CIRCULATING VALVE OPEN

131
SCREEN VALVE CLOSED
157
113
61
63
41
158
219
156
154
160
156
223
69
71
65
211
INNER FOOT VALVE CLOSED 77
75
207
173
205
189
191
187
171
OUTER FOOT VALVE CLOSED
199
179
177

CIRCULATING VALVE

INDEXING TOOL

HOOKWALL PACKER

SWIVEL SUB AND SCREEN VALVE

SLIP JOINT, LATCH, VALVE - BOTTOM HOLE ASSEMBLY

SLURRY UP PARTICULATE PLACEMENT TOOL

CROSS REFERENCE TO RELATED APPLICATION

This application discloses improved apparatus for performance of the method disclosed and claimed in the application of Glenn T. Colomb and David L. Farley filed contemporaneously herewith entitled Sand Placement, Ser. No. 262,369 filed May 11, 1981, the disclosure of which is incorporated herein by reference and a copy of which forms part of this application in case it becomes necessary to incorporate same herein word for word.

BACKGROUND OF THE INVENTION

Some idea of the history of sand and gravel packing may be gleaned by reference to the following publications:

Composite Catalog of Oil Field Equipment and Services:

1964 Edition, page 2906 et seq, Layne & Bowler;
1966 Edition, page 949 et seq, Brown Oil Tools;
1968 Edition, page 318 et seq, B & W Inc.;
1968 Edition, pages 4734 TIW;
1970 Edition, page 4257 et seq, Kirk Shirley Oil Tools;
1972 Edition, page 3434, Otis;
1972 Edition, pages 377–384 Baker Also see U.S. Pat. Nos.

2,154,461—Layne (Layne & Bowler),
4,049,055—Brown (Brown Oil Tools),
3,710,862—Young et al (Otis),
3,987,854—Callihan et al (Baker), and the art set forth in the above referred to Colomb and Farley application.

SUMMARY OF THE INVENTION

According to the invention there is provided gravelling apparatus comprising a number of interconnected components whose nature and function is as follows, set forth in order from the top down:

Circulating Valve:

A telescopic joint, J-slot and sleeve valve, which when open allows reverse circulation down the annulus and up the tubing to flush out the tubing.

The upper tube of the telescopic joint connects to a string of work tubing thereabove. The lower tube of the telescopic joint connects to dual pipe forming the tube part of an indexing tool therebelow.

Indexing Tool:

Concentric tubes, connected by a pin and slot travel limit, allow positioning of valves below the indexing tool. Positioning is achieved by manipulation, with the work string, of the pin tube relative to the slot tube. The slot tube is connected to apparatus, described below, which is fixed in the well bore.

The slot tube is a dual pipe providing two flow passages through the packer mandrel and telltale screen therebelow. An exit port at the upper end of the dual tube communicates the dual tube annulus with the tubing-casing annulus.

The pin tube, which is outside the slot tube, connects by a J slot to the packer mandrel therebelow.

Hookwall Packer:

A tubular packer mandrel has a seal therearound, engageable with well casing when the anchor carried by the mandrel is actuated to engage the well casing.

Liner with screen is hung from the mandrel. The seal insures that all production is from the formation below the packer.

Belly springs connected to the anchor provide frictional means engaging the well casing so that the anchor and seal can be set by manipulating the tubing relative to the anchor.

Swivel Sub and Screen Valve:

A swivel sub connects the packer mandrel to the liner and screen therebelow so that the packer can be set by rotation of the work string without rotating the liner and screen.

A valve is formed by an entry port in the outer pipe of the dual pipe and by straddle seals around the dual pipe above and below the entry port and by seats in the mandrel and liner above and below a screened port at the upper end of the liner.

The lower seal can seat in the mandrel and prevent all flow into the dual tube entry port, as is desired during injection of clear fluid into the formation to test permeability.

The lower seal can seat in the liner below the screened port to prevent return flow of clear fluid through the main screen during packing of the liner-casing annulus with sand or gravel or other particulates, while clear fluid enters the dual tube entry port, from the screened port in the liner. The upper seal, which is optional, seats in the mandrel to prevent flow of clear fluid through the packer J connection and the indexing tool to the liner casing annulus. When sand covers the screened port, pressure rise indicates the liner casing is full of sand.

Optionally, the lower seal can be placed between its upper and lower seats so that clear fluid can flow to the dual tube entry port through the main screen as well as the screened port, if desired, during the final or squeeze phase of packing.

With the lower seal elevated into the mandrel, the same position as described above for fluid injection, there is prevented down flow of fluid from the annulus above the packer into the liner during reverse circulation flushing of the work string.

Slip Joint, Latch, Valves, Bottom Hole Assembly:

Below the screen valve the dual pipe reverts back to a single tube or stinger, a continuation of the flow passage of the work string, which provides means to carry fluid through the inside of the screen to the lower end of the liner-casing annulus via an outer sleeve valve at the lower end of the screen. The outer valve is closed after the sand has been placed outside the liner. A semi-locking latching receptacle in the outer sleeve valve receives an inner sleeve valve at the lower end of the stinger which closes the lower end of the stinger when it is withdrawn from the receptacle. A slip joint in the stinger allows manipulation of the screen valve above without disturbing the two sleeve valves. An automatic latch connects upper and lower portions of the stinger to facilitate assembly.

Novel features of the foregoing construction may be better appreciated by a comparison with some of the prior art gravel placement apparatus.

Although cementing tools are known which employ direct circulation, tools employed in gravelling appear to be directed to sand placement by reverse circulation effected by a crossover connected to the lower end of the work string. The present tool however employs direct circulation in conjunction with gravel packing and eliminates the crossover heretofore employed.

In prior art reverse circulation gravelling assemblies (see e.g. the tool disclosed in the Otis catalogue listed above) if a tell tale screen is employed it is positioned below the main screen to filter the return flow clear fluid from the liner casing annulus. According to the present invention the return fluid screen is above the main screen and is combined with the seal socket which initially receives the dual pipe packer by-pass employed during gravelling and which later receives the lower end of the production tubing.

An indexing tool is included in the assembly of the present invention which converts the dual pipe packer bypass port and the seal socket into a valve by enabling the dual pipe seals above and below the dual pipe port to be positioned to predetermined positions relative to the seal socket as desired for injecting clear fluid into the formation, circulating gravel and squeezing the gravel pack, and flushing.

Foot valves control fluid flow between the lower end of the liner and the annulus therearound and also between the stinger forming the lower end of the tubing and the exterior thereof, and a latching socket holds the two valves in nested relationship.

A circulating valve is employed above the indexing tool. The circulating valve, foot valves, and screen valve provide means to control fluid flow through the assembly to effect the slurry up gravel placement and related operations according to the invention.

Other features of novelty of the invention and its objects and advantages will be apparent from the following description of preferred embodiments.

BRIEF DESCRIPTION OF THE DRAWINGS

For a detailed description of the invention reference will now be made to the accompanying scale drawings wherein.

FIGS. 1–3 are schematic drawings showing apparatus according to the invention respectively in the pressure testing and injecting position, in the circulating and gravel pack position, and in the reverse circulating position. It may be mentioned here that the apparatus may also be placed in a squeeze position, not shown, and that after flushing by reverse circulation a production tubing is to be installed.

FIGS. 1A, 2A, 3A are elevations showing the various positions of the J slot controlling the position of the circulating valve.

FIGS. 1B, 2B, 3B are elevations of the pin and slot of the indexing tool for various positions of the screen valve.

The conventions of the United States Patent and Trademark Office are employed to indicate materials, from which it will be seen that the parts are all made of metal, e.g. steel, except for the seals which are made of rubber, natural or synthetic, or other suitable packing material.

DESCRIPTION OF PREFERRED EMBODIMENTS

Referring now to FIGS. 1–3, 1A–3A, and 1B–3B, there is shown gravelling apparatus including a string of work tubing 21.

Circulating Valve

Figure 4:
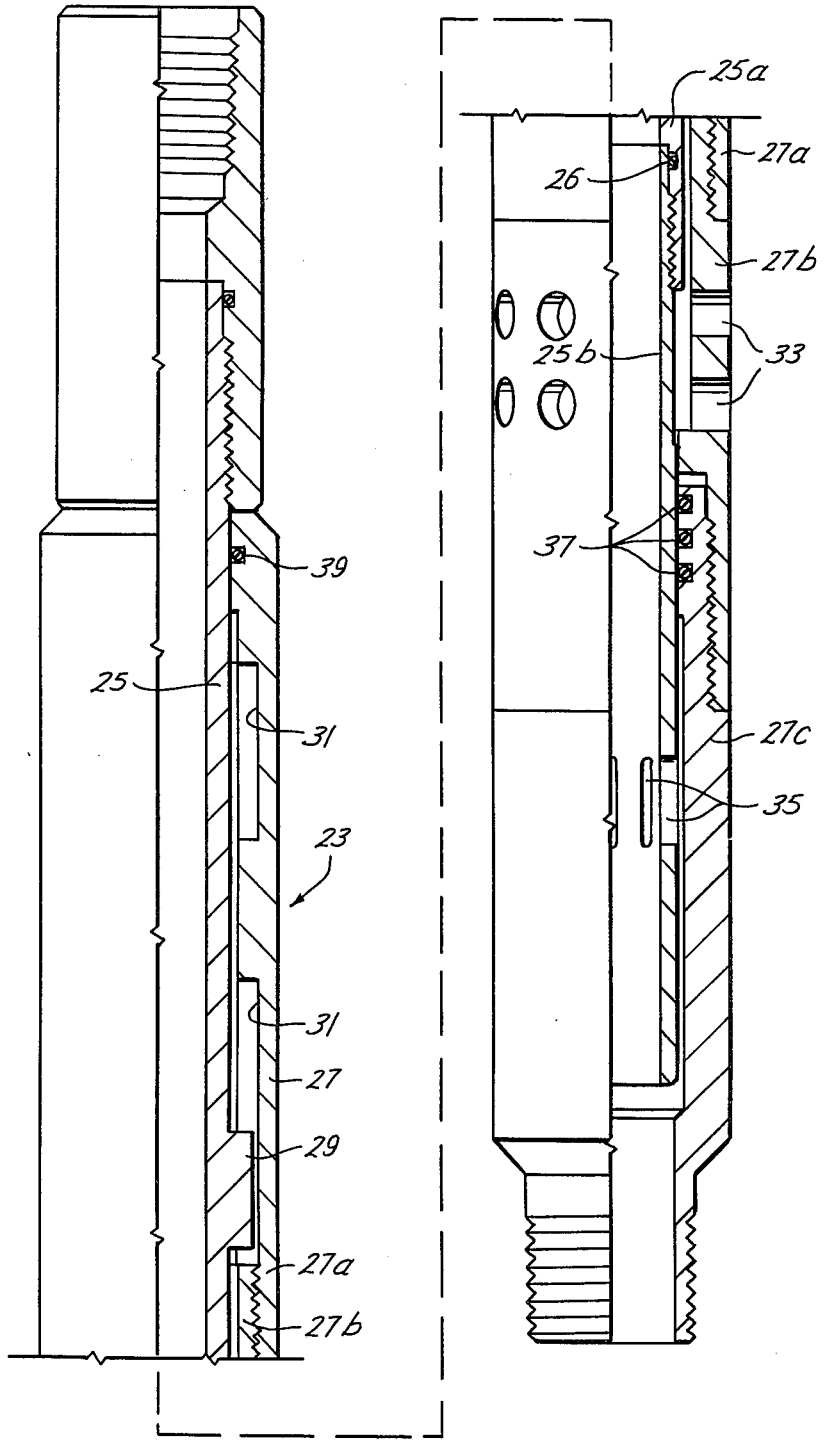
FIGS. 4–9 are axial sections through apparatus according to the invention showing respectively the circulating valve, indexing tool, hookwall packer, swivel sub and screen valve, and the slip joint-latch-valve of the bottom hole assembly.
Figure 4A:
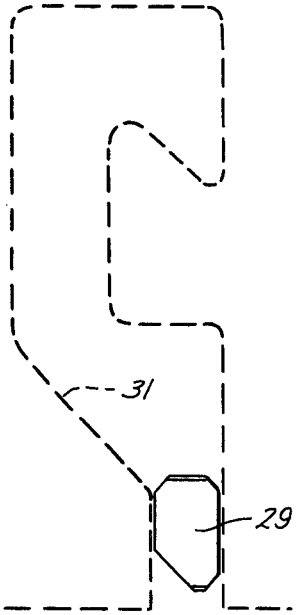

A circulating valve 23 is threadedly connected to the work tubing. Referring now also to FIGS. 4 and 4A, the circulating valve includes telescoping inner and outer tubular members 25, 27, with axial travel limiting J slot and pin means comprising pin 29 and J slot 31.

Inner member 25 comprises upper and lower members **25*a* and 25*b* threadedly connected together and sealed by O-ring 26. Outer member 27 comprises upper, intermediate, and lower members 27*a*, 27*b*, 27*c*, threadedly connected together. The outer member is provided with radial ports 33 and the inner member is provided with radial ports 35.**

As best shown in FIG. 4, O-rings 37 separate ports 33, 35 when the valve is closed. O-ring 39 cooperates with O rings 37 to form a straddle packoff between the inner and outer members above and below ports 33, 35 when the valve is open and the ports are aligned as shown in FIG. 3.

Figures 1, 1A, 1B:
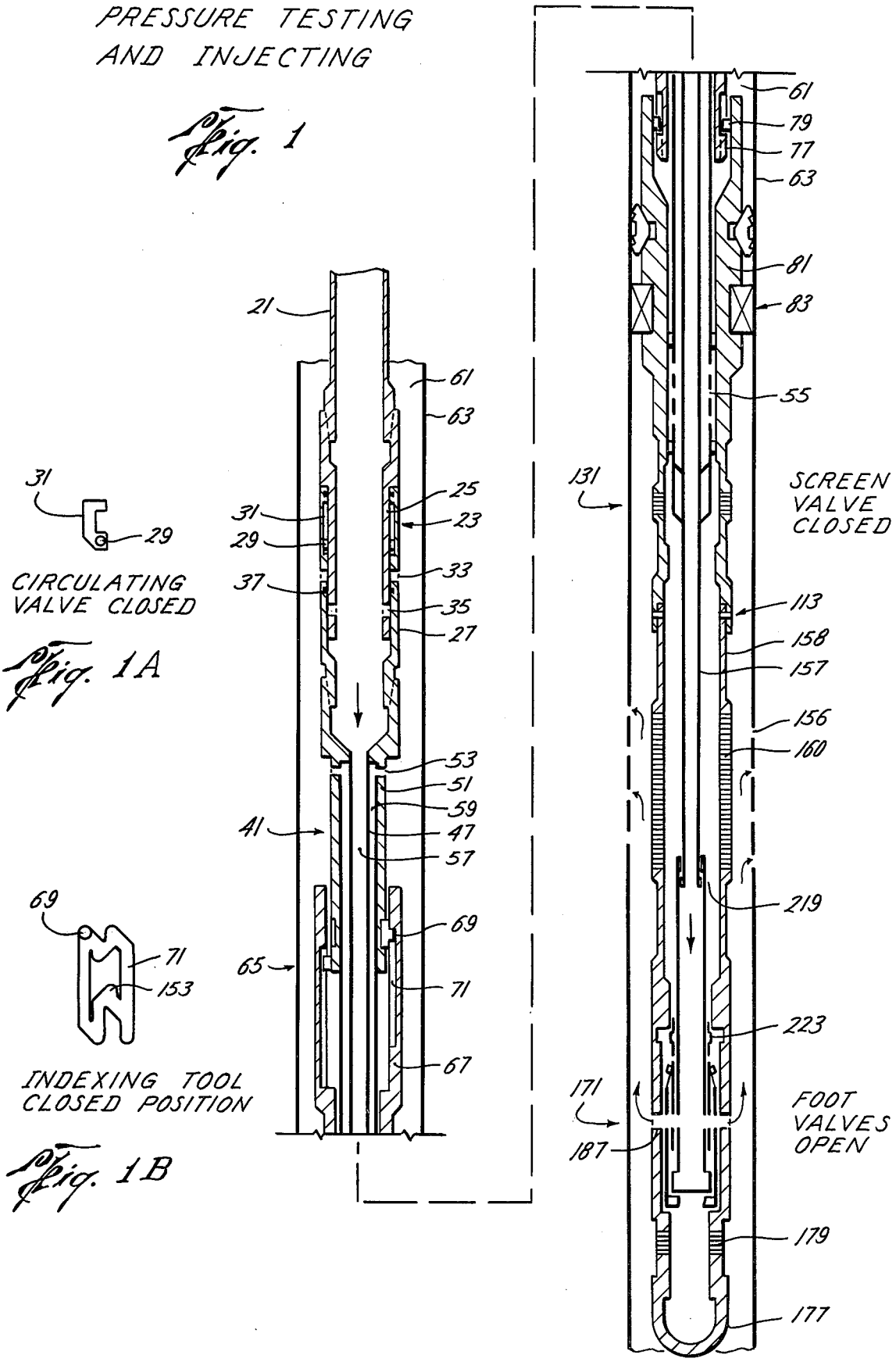
Figures 3, 3A, 3B:
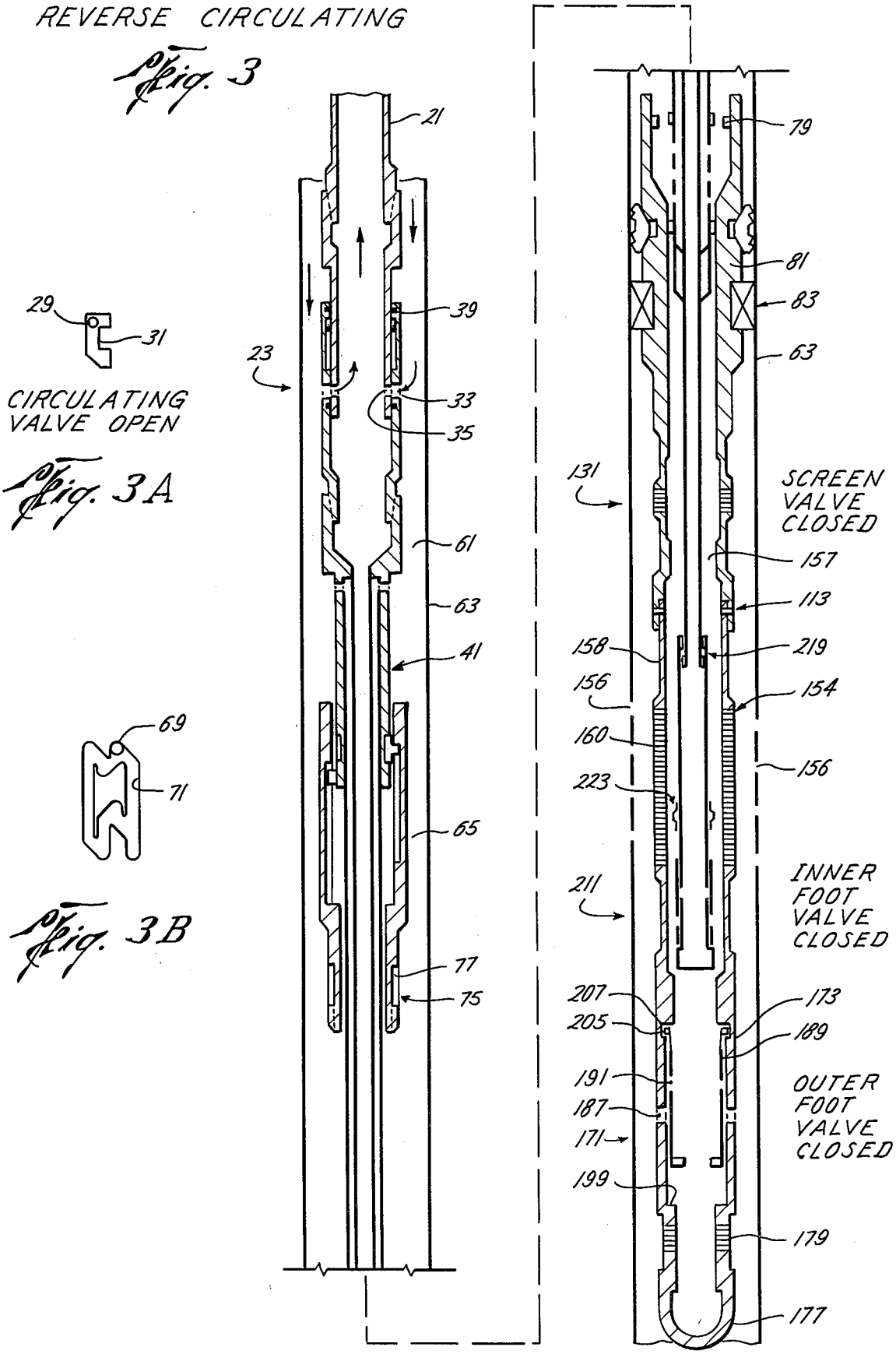

FIGS. 1A and 2A show the pin and slot 29, 31 of the J slot means in position corresponding to the circulating valve being closed; in FIG. 3A the pin and slot are shown in valve open position.

Dual Pipe Packer By Pass

Figure 5:
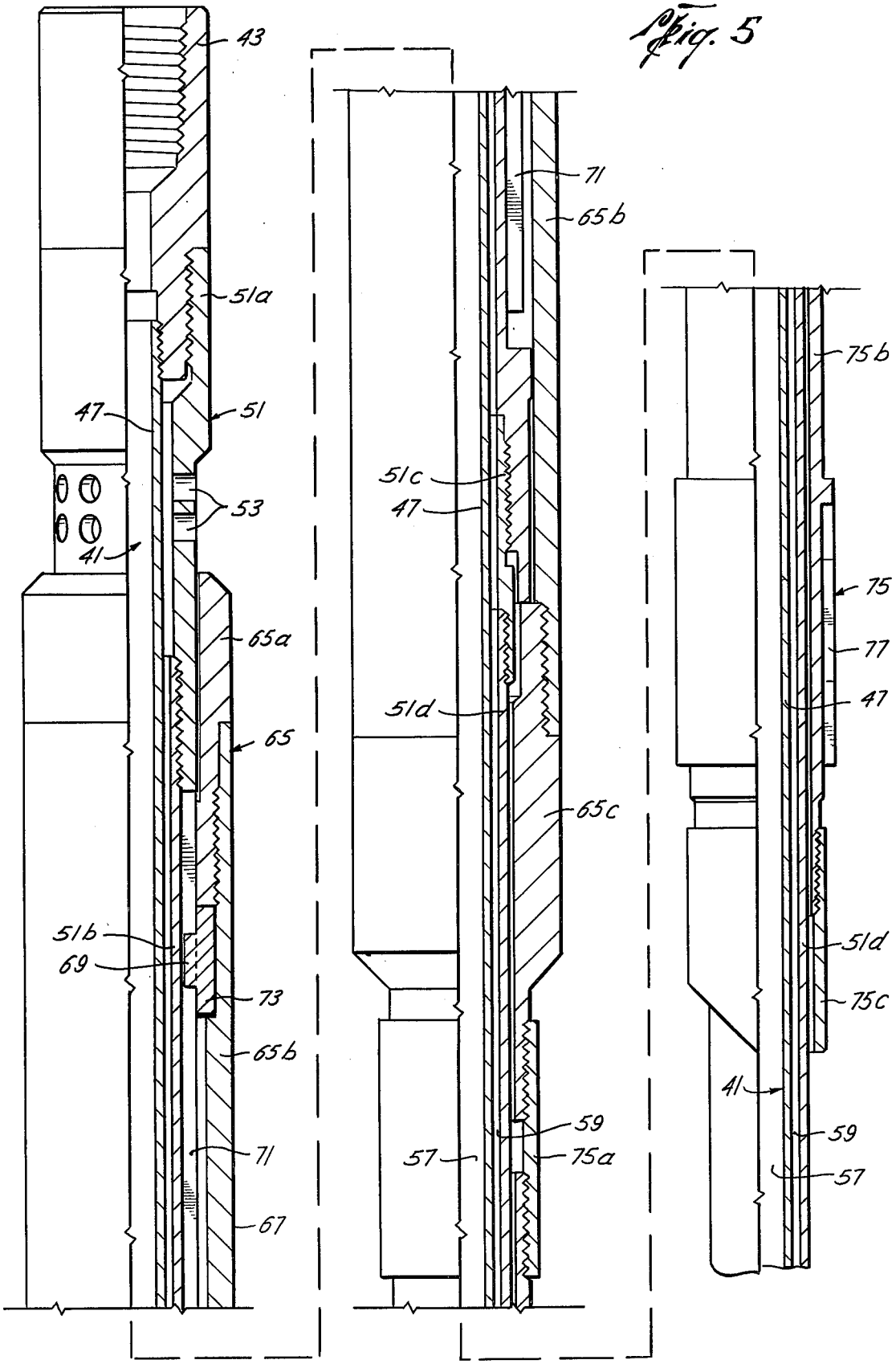
Figure 7:
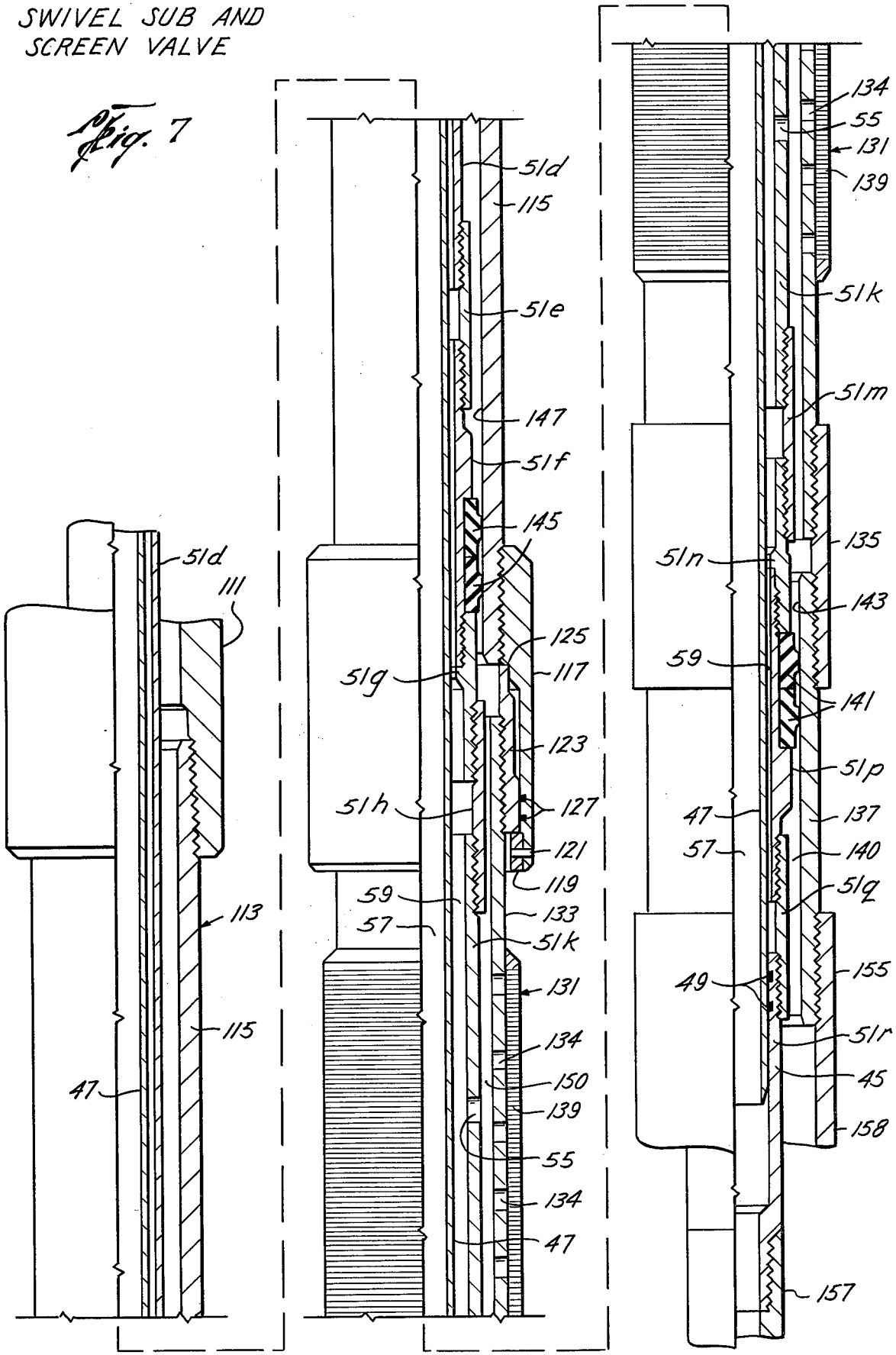

Threadedly connected to the lower end of member 27 of the circulating valve is packer bypass dual pipe 41. Referring now also to FIGS. 5 and 7, dual pipe 41 includes upper and lower threaded tubular conversion subs 43, 45, inner pipe 47 threadedly connected to the upper sub 43 and fitting slidably in sub 45 (being sealed thereto by O-ring 49) and outer pipe 51. Outer pipe 51 comprises pipe sections **51*a*–51*h*, 51*k*, 51*m*, 51*n*, 51*p*, 51*q* threadedly connected together, section 51*a* being threadedly connected to upper sub 43 and section 51*q* being threadedly connected to lower sub 45. At the upper end of the outer tube are radial exit ports 53. Near the lower end of the outer tube are one or more entry ports 55.**

The dual pipe provides a central flow passage 57 which is a continuation of the axial flow passages provided by the work string and the circulating valve. The dual pipe provides an annular flow passage 59 which communicates via exit ports 53 with annulus 61 between work string 21 and well casing 63, and communicates via inlet ports 55 with various portions of the apparatus as will be described hereinafter.

Indexing Tool

As shown in FIG. 5, indexing tool 65 comprises outer pipe 51 and a tubular case 67 concentrically, slidably disposed thereabout and axial travel limit means including pin 69 carried by case 65 on its interior and slot 71 formed on the exterior of pipe 51. In FIGS. 1–3 an alternative arrangement is shown in which the pin is on pipe 51 and the slot is in case 67.

Referring once more to the FIG. 5 construction, case 65 includes three tube sections **65*a*, 65*b*, 65*c* threadedly connected together. Ring 73, which carries pin 69, is captured between shoulders on sections 65*a* and 65*b*, to prevent axial motion thereof but allowing relative rotation of ring 73 and the case. If desired, ring 73 can be held tightly between the shoulders to prevent or retard such relative rotation. In FIGS. 1–3 an alternative arrangement is shown in which the pin is on outer pipe 51**.

J-Slot Packer Connector

Threadedly connected to case section 65*c* is J-slot packer connector 75 (see especially FIGS. 3 and 5) including collar 75*a*, mandrel 75*b*, and tubular guide shoe 75*c* all threadedly connected together. Mandrel 75*b* is provided with multiple J-slots 77 adapted to receive a plurality of pins 79 on mandrel 81 of packer 83. The mandrel, connector, slots and pin form a species of bayonet joint by means of which the packer mandrel and the indexing tool are releasably connected.

Hookwall Packer

Figure 6:
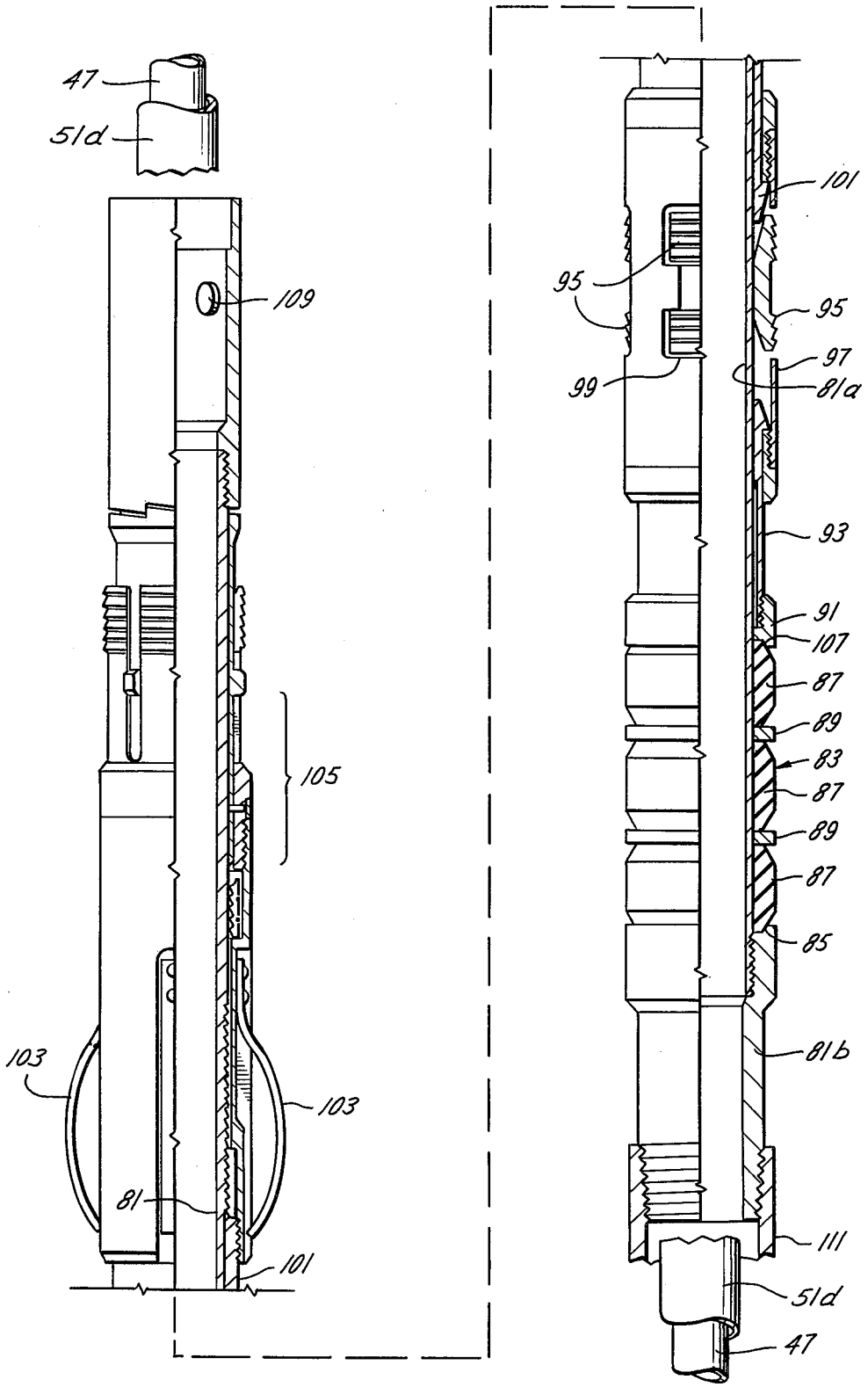

Hookwall packer 83 is shown schematically in FIGS. 1–3. Preferably an Arrow XL packer is used as shown in detail in FIG. 6. Referring to FIG. 6, packer 83 includes a mandrel 81 formed of tube 81*a* and a connector 81*b* threadedly connected to the lower end of the tube. Connector 81*b* supports a number of annular elements stripped over tube 81*a*, namely, rings 87 of packing material such as rubber, metal spacer rings 89, wedge ring 91, compression sleeve 93, double tapered wall engaging slip cage 97 having windows 99 through which may extend the slips, wedge ring 101 carrying belly springs 103 for frictionally engaging the inside of the well casing, and releasable latching means 105 for securing wedge ring 101 against axial motion relative to mandrel 81. Latching means 105 is releasable by a combination of rotation and axial motion of the mandrel 81 relative to wedge ring 101 as the latter is held stationary by springs 103. Upon release of the latching means, an upward movement of the mandrel causes wedge rings 101 and 93 to approach and move slips 95 radially outwardly to engage the well casing and causes shoulder 85 to approach shoulder 107 formed by ring 91, thereby to axially compress packing rings 87 and move them radially into sealing engagement with the well casing and mandrel.

The upper end of the mandrel tube 81 carries pin 79 adapted to be received in J-slots 77 (see FIG. 1) at the lower end of the indexing tool. Threaded pin connector 81*b* at the lower end of the mandrel is adapted to be connected by threaded collar 111 to the upper end of swivel sub 113 therebelow.

Swivel Sub

Swivel sub 113 forms part of the body of screen valve 131 and as shown schematically in FIGS. 1–3 is at the lower end of the screen valve. Preferably, however, the swivel sub is at the upper end of the screen valve as shown in detail in FIG. 7.

Referring now especially to FIG. 7, swivel sub 113 includes tube 115, collar 117 threadedly connected thereto, internal ring 119 secured to the inner periphery of the lower end of ring 119 by shear pins 121, and ring 123 captured between ring 119 and shoulder 125 on collar 117 but rotatable relative thereto, and O-rings 127 sealing between ring 123 and ring 119.

The swivel sub enables rotation of the packer mandrel during release of its latch, prior to setting the packer, without the liner and screen hung from the packer mandrel being turned. The shear pins enable the packer and indexing tool to be separated from the liner and screen therebelow, if need be, by an upward pull on the work string.

Screen Valve

Swivel tube 113 forms part of the tubular body of screen valve 131, the body of which includes seat tube 115, collar 117, ring 119, ring 123, ported tube 133 (having ports 134) threadedly connected to ring 123, and collar 135 threadedly connected to ported tube 133. Preferably ported tube 133 is covered by well screen 139 secured therearound over its ports. The screened ported tube provides one inlet to the screen valve. Another inlet passage 140, is provided between seat tube 137 and section 51*q* of the outer pipe of dual pipe 51.

The core of the screen valve is provided by sections 51*f*, 51*g*, 51*h*, 51*k*, 51*m*, 51*n*, 51*p* of the outer pipe of dual pipe 51. A lower seal comprising elastomer seal rings 141 is adapted to seal with the lower valve seat provided by the smooth inner periphery 143 of seat tube 137. Seal rings 141 are captured between shoulders formed by outer pipe sections 51*n* and 51*p*.

An upper seal provided by elastomer seal rings 145 is adapted to seal with the upper valve seat provided by the smooth inner periphery 147 of seal tube 115. Seal rings 145 are captured between shoulders formed by outer pipe sections 51*f* and 51*g*.

The upper seal never leaves its seat and may be regarded as a valve stem packing. If it were omitted, fluids entering the valve chamber formed between the body and core of the screen valve could move up outside the dual pipe inside the packer mandrel into the indexing tool. Although such fluid is generally clear, there could be enough sand passed through screened ported tube 133 to sand up the indexing tool and render it inoperative.

Between upper seal 145 and lower seal 141 a valve outlet is provided by inlet ports 55 in outer pipe section 51*k* of the dual pipe.

Depending on the position of the indexing tool, lower seal 141 may be in the lower position shown in FIGS. 2 and 7 in which it seals with lower seat 143, blocking off flow through paraxial inlet passage 140 while leaving clear a flow passage 150 through the valve chamber from screened ported tube 133 to dual pipe ports 55. If seal 141 is moved up to the upper position shown in FIG. 1, where it engages and seals with upper seat 147, both passages 140 and 150 to ports 55 are blocked. If seal 141 is in an intermediate position where it engages neither the upper nor the lower seat, both flow passages 140, 150 to ports 55 are open; this corresponds to a position of the indexing tool in which pin 69 is at position 153 in the slot (see FIG. 1B).

Liner and Screen

As shown in FIG. 7, to the lower end of valve seat tube 137 (the lower end of the valve body) is threadedly connected the upper end 155 of a liner 154 (see also FIG. 1) comprising a suitable length of blank pipe 158 and screen 160 opposite the perforations 156 in the well casing. A stinger formed by a string of pipe 157 extends down inside the liner. The length of the liner and stinger may be several hundred feet and to that extent FIGS. 1–3 are not to scale. The lower end 159 of the liner (screen and blank pipe) is threadedly connected to outer foot valve adapter sleeve 161, as shown in FIG. 8.

Outer Foot Valve

Figure 8:
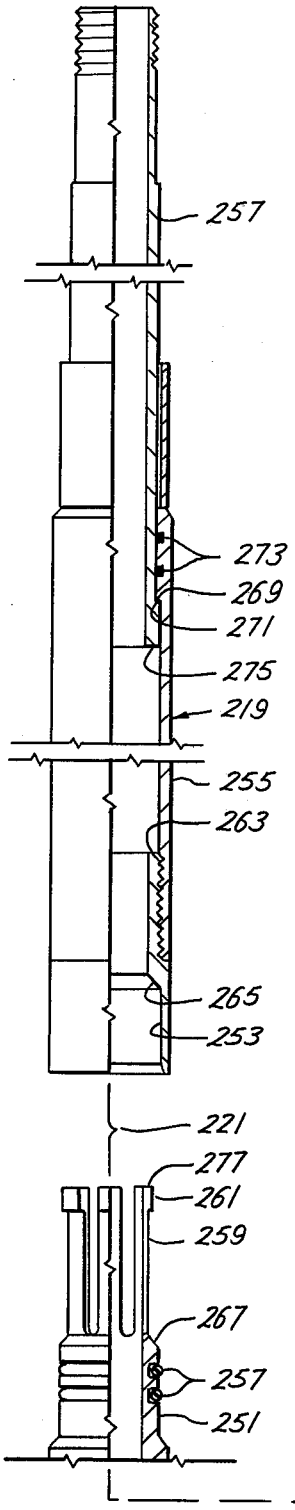
Figure 8:
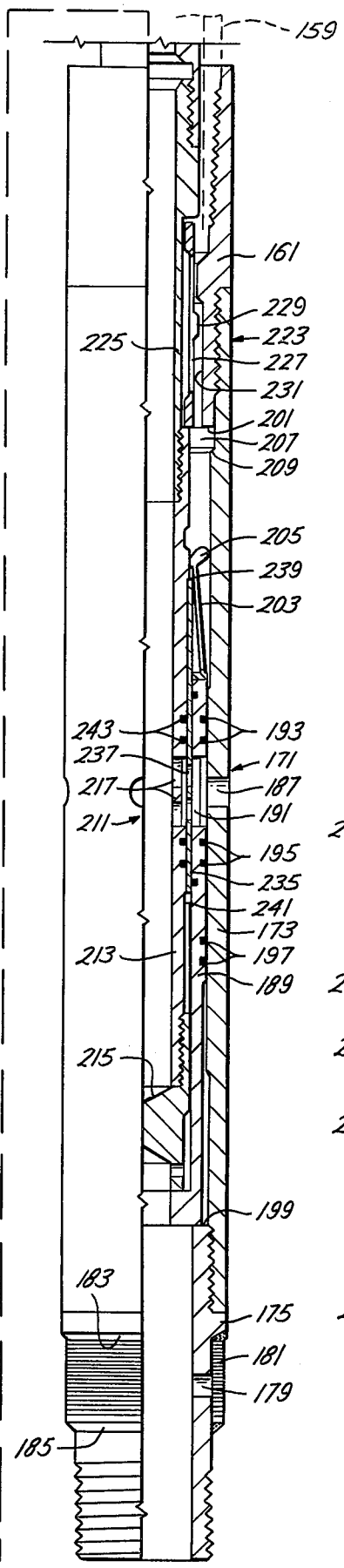

Referring now especially to FIG. 8, outer foot valve 171 is a sleeve valve including an outer sleeve or body 173 threadedly connected at its upper end to adapter sleeve 161 and at its lower end to bottom closure means including nipple 175 threadedly connected to a bull plug 177 (FIGS. 1–3). If desired, nipple 175 may, as shown, be provided with ports 179 covered by screen 181 to permit flushing of the bottom hole assembly. Screen 181 is welded to nipple 175 at 183, 185.

Outer sleeve valve body 173 is provided with a plurality of flow ports 187. Valve core sleeve 189 is axially slidable within body 173 to control flow through radial ports 187. Core sleeve 189 has a plurality of radial ports 191 adapted to register with ports 187 when the outer foot valve is in the open position shown in FIGS. 1, 2 and 8. Upper and intermediate O-rings 193, 195 seal between core sleeve 189 and body 173 above and below ports 191, 187 when the valve is open. When core sleeve 189 is elevated, ports 191, 187 are no longer in register and intermediate O-rings 195 and lower O-rings 197 seal above and below ports 191 between the core and body, ports 191 being closed by the valve core. At the same time upper O-rings 193 and intermediate O-rings 195 seal between the valve core and body above and below ports 191, which are closed by the valve body. Downward axial travel of the valve core is limited by upwardly facing shoulder 199 formed by the upper end of nipple 175. When the core abuts shoulder 199 the valve is open. Upward axial travel of core 189 is limited by downwardly facing shoulder 201 formed by the lower end of adapter sleeve 161. When spring fingers 203 attached to the upper end of the valve core abut shoulder 201, the valve is in closed position; at the same time dogs 205 on the ends of the spring fingers snap out into annular groove 207, formed between shoulder 201 and upwardly facing shoulder 209 in the valve body, to latch the valve in closed position, as shown in FIG. 3.

Inner Foot Valve and Collet Connector

Figure 9:
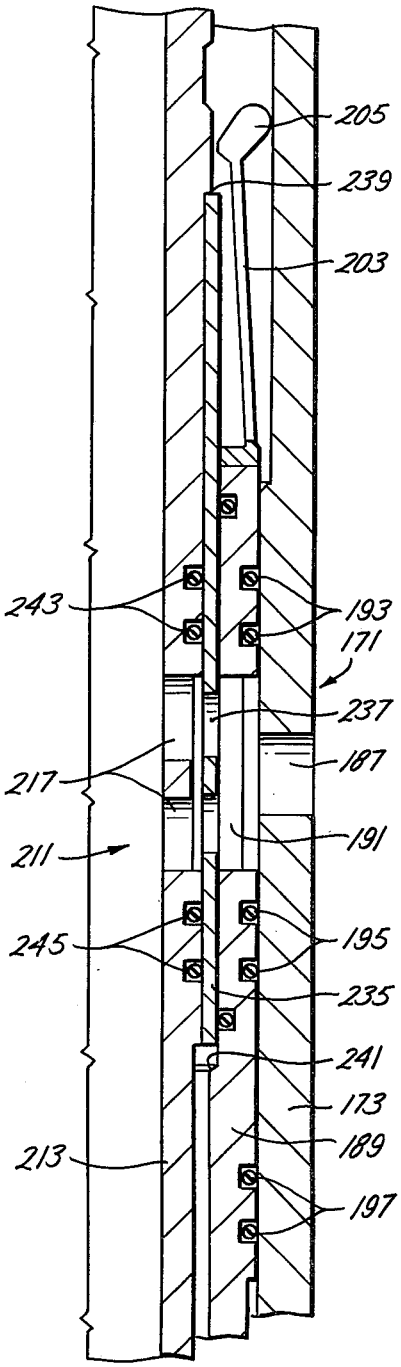

Concentrically disposed within outer foot valve 171 is inner foot valve 211 (see FIGS. 3, 8 and 9). Valve 211 includes a tubular body 213 closed at its lower end by cap 215 threadedly connected thereto and having ports 217 in its side circumferentially and axially spaced thereabout. The upper end of the body is connected to a continuation of the flow passage comprising the work string, inner pipe of the dual pipe, and the stinger, such continuation including telescopic joint 219, automatic latch connector 221 (not shown in FIGS. 1–3) and collet connector 223. Specifically, valve body 213 is threadedly connected at its upper end to tubular mandrel 225 of collet connector 223. Circumferentially disposed around mandrel 225 are a plurality of spring bars 227 each carrying a key or lug 229 received in annular recess 231 in adapter sleeve 161. The collet connector is a semi-locking device in that upon exertion of axial force in excess of a certain amount, mandrel 225 can be pulled out of or inserted into adapter sleeve 161, but a lesser force will not effect such relative movement. Collet connector 223 also is a lost motion device in that recess 231 is longer axially than keys 229, allowing relative axial motion of the stinger and liner as may be required to actuate the foot valves without disconnecting the collet connector, which secures the stinger continuations (latch 221, mandrel 225, inner valve 211) to the liner continuations (adapter 161, outer valve 171).

Returning to the inner foot valve, around inner valve body 213 is valve sleeve 235 having circumferentially and axially spaced thereabout a plurality of ports 237. Sleeve 235 is limited in its upward travel relative to body 213 by downwardly facing shoulder 239 on body 213, in which position sleeve ports 237 are axially in register with body ports 217, and the inner foot valve is open. Upwardly facing shoulder 241 on the core of the outer foot valve prevents sleeve 235 from dropping out of the open position so long as the inner valve is within the outer valve.

When inner valve body 213 is elevated relative to the core of the outer valve, e.g. by lifting up the stinger relative to the liner beyond the full extension of telescopic joint 219, as shown in FIG. 3, collet connector 223 becoming disconnected, the upper end of valve sleeve 235 strikes lugs 205 of outer valve 171 and is prevented from rising along with inner valve body 213. This causes body 213 to move up inside sleeve 235 so that body ports 217 are no longer in register with sleeve ports 237 and the two sets of ports are blocked by the sleeve and body respectively. Leakage between the sleeve and body is prevented by upper and lower sets of O-rings 243, 245. By such elevation of the valve body relative to the valve sleeve, the inner foot valve is closed.

Upon further elevation of the stinger relative to the liner, fingers 205 are carried upwardly by the upper end of sleeve 235 until dogs 205 snap into groove 207, closing the outer foot valve and latching it in that position. That is the position of the foot valves shown in FIG. 3.

Automatic Latch and Telescopic Joint

It will be understood from the above description that latch 221 remains connected in all positions of the apparatus, as shown in FIGS. 1–3. Latch 221 merely provides a convenient means for assembly of the apparatus. Since the liner, including the screen, may be several hundred feet long, it is not run into the well as a unit. Initially the foot valve assembly is run into the well, then liner sections, and finally the packer. With the packer mandrel suitably suspended in the well, e.g. by slips in the rotary table or other surface equipment, the several hundred feet of stinger are run into the well inside the liner, then the dual pipe is run in, and as the dual pipe is connected to the packer mandrel by J slot 65, automatic latch 221 engages the lower end of the stinger with the foot valves. Thereafter the circulation joint 23 is connected to the dual pipe and the whole assembly is lowered to the desired level with screen 160 opposite casing perforations 156 (or if the liner is run in open hole, the screen is placed at the level of the producting formation).

Since the automatic latch is connected while its parts are down hole, it is constructed so as to engage without manual guidance. It comprises upstanding pin 251 threadedly connected at its lower end to collet mandrel 225. Pin 251 fits telescopically into socket 253 threadedly connected to the lower end of outer tube 255 of telescopic joint 219. O-rings 257 are adapted to seal with socket 253. A plurality of spring fingers 259, extending from the upper end of the pin, have lugs 261 at their upper ends adapted to snap behind upwardly facing shoulder 263 formed by the upper end of socket 253. Guide bevels 265 facilitate entry of fingers 259 and pin 251 into socket 253 in case of initial misalignment.

Referring once more to telescopic joint 219, outer tube 255 is axially slidable upon inner tube 267 of the joint. Shoulders 269, 271 on the outer and inner tube respectively, limit extension of the telescopic joint. O-ring seals 273 carried by the upper end of the outer tube seal between the two tubes. Contractive travel of the telescopic joint is limited by shoulder 275 formed by the lower end of the inner tube engaging the shoulders formed by the upper ends 277 of spring fingers 259. The contracted position of the joint is shown in FIG. 2, the extended position of the joint is shown in FIGS. 1, 3, and 8.

Operation

The operation of the apparatus is best understood by reference to FIGS. 1–3. In FIG. 1 water or other clear liquid is pumped down a first fluid passage provided by the string of work tubing, the inner pipe of the dual pipe, the stinger, the automatic latch, the collet connector, and the foot valves to the liner—casing annulus, return flow being shut off by the closed screen valve.

In FIG. 2, slurry is pumped down the first passage and out around the liner and screen into the formation, and the screen valve is open allowing up flow through a second fluid passage provided by the annulus of the dual pipe and the tubing casing annulus above the packer, entrance to the second passage being via a third passage 150 (see FIG. 7) through the screen valve.

In a third position, not shown, with the screen valve in position corresponding to pin 69 of the indexing tool being at 153 in the slot (FIG. 1B) a fourth passage 140 (see FIG. 7) is also open to permit return flow to the second passage from the interior of screen 160 as more clear fluid is squeezed from the sand or gravel pack around the liner and screen.

In a fourth position shown in FIG. 3, clear flushing fluid flows down the annulus and up the tubing via the circulation valve, which is now open, the foot valves and screen valve being closed to keep pressure off the formation.

Thereafter the retrievable tool comprising the work string, circulating valve, indexing tool, dual pipe and screen valve core, swivel sub, stinger, telescopic joint, automatic latch, collet connector mandrel, and inner valve, are pulled out of the hole by disconnecting the J-slot connector at the packer mandrel the remainder or production part of the apparatus comprising the packer, swivel sub, screen valve body, liner (blank pipe and screen) collet collar, outer valve, and bull plug, are left in the hole.

A string of production tubing is then run in the well and sealed to the screen valve seats or inside the packer mandrel.

While a preferred embodiment of the invention has been shown and described, modifications thereof can be made by one skilled in the art without departing from the spirit of the invention.

If after testing the formation for permeability, it is found that a higher permeability would be desirable, the tool may be used, in the same mode as for testing permeability, to acidize the formation, i.e. inject acid instead of water.

Although the preferred embodiment disclosed above employs a dual pipe 47/51, the construction could be simplified by omitting the outer tube of the dual pipe and using the annulus between packer mandrel 81 and the inner tube of the dual pipe as a flow passage.

I claim:

1. Well completion apparatus for use in a well including a well casing, said apparatus comprising a liner including a foraminous portion, support means for supporting said liner within the casing, packing means for sealing between the liner and casing above said foraminous portion, first passage means for conducting fluid from above said packing means down through the inside of said liner out of contact therewith to below said foraminous portion and thence outwardly to the exterior of the liner, second passage means for conducting fluid from below said packing means to above said packing means, and third passage means above said foraminous means for conducting fluid from outside said liner to said second passage means, said third passage means including flow control valve means, whereby with said flow control valve means closed fluid can be conducted via said first passage means to the exterior of said liner and injected into the surrounding earth formation under pressure.

2. Well completion apparatus for use in a well including a well casing, said apparatus comprising a liner including a foraminous portion, support means for sealing between the liner and casing above said foraminous portion, first passage means for conducting fluid from above said packing means down through the inside of said liner out of contact therewith to below said foraminous portion and thence outwardly to the exterior of the liner, second passage means for conducting fluid from below said packing means to above said packing means, and third passage means above said foraminous means for conducting fluid from outside said liner to said second passage means, said first passage means including valve means above said packing means operable when said packing means is sealing between the lining and casing to establish communication between said first passage means and the casing annulus between said first passage means and said casing, whereby reverse circulation can be established down the annulus and up through said first passage means above said packing means.

3. Well completion apparatus for use in a well including a well casing, said apparatus comprising a liner including a foraminous portion, support means for sealing between the liner and casing above said foraminous portion, first passage means for conducting fluid from above said packing means down through the inside of said liner out of contact therewith to below said foraminous portion and thence outwardly to the exterior of the liner, second passage means for conducting fluid from below said packing means to above said packing means, and third passage means above said foraminous means for conducting fluid from outside said liner to said second passage means, said first passage means further including second valve means for closing the lower end of said first passage means, whereby when such reverse circulation is established said liner is isolated from such circulation.

4. Apparatus according to claim 1, 2 or 3 said third passage means including a foraminous part in series with flow through said third passage means, whereby upon conduction of slurry down said first fluid passage means and up outside said liner, said foraminous part will hold back particulates in said slurry while allowing clear fluid to flow through said third passage means to said second passage means, and when particulates have built up around said liner to a level above said foraminous part there will be a rise in slurry pressure indicative of the particulates having reached such level.

5. Apparatus according to claim 2 or 3, said third passage means including flow control valve means, whereby with said flow control valve means closed fluid can be conducted via said first passage means to the exterior of said liner and injected into the surrounding earth formation under pressure.

6. Apparatus according to claim 5, including sleeve means outside said first passage means above said packing means adapted to be fixed against movement in the well easing, e.g. by connection to said support means, and pin and slot means interconnecting said sleeve means and said first passage means defining axial relative positions thereof including a first position in which said flow control valve means is closed and a second position in which said valve means is open.

7. Apparatus according to claim 6, said flow control valve being actuatable by motion including axial translation of the upper part of said first passage means, the lower part of said first passage means within said liner including a telescopic joint allowing axial motion of the upper portion of said first passage means without motion of said lower part of said first passage means.

8. Apparatus according to claim 6 including bayonet joint means releasably connecting said sleeve means to said liner above said support means and above said packing means, whereby said liner can be supported by and run into the well on said first passage means and said first passage means later freed from said liner and withdrawn from the well.

9. Apparatus according to claim 5, said flow control valve being actuatable by motion including axial translation of the upper part of said first passage means, the lower part of said first passage means within said liner including a telecopic joint allowing axial motion of the upper portion of said passage means without motion of said lower part of said first passage means.

10. Apparatus according to claim 1, 2 or 3, said third passage means including flow control valve means, whereby with said flow control valve means closed fluid can be conducted via said first passage means to the exterior of said liner and injected into the surrounding earth formation, said third passage means including a foraminous part in series with flow through said third passage means, whereby when said flow control valve is open, upon conduction of slurry down said first fluid passage means and up outside said liner, said foraminous part will hold back particulates in said slurry while allowing clear fluid to flow through said third passage to said second passage, and when particulates have built up around said liner to a level above said foraminous part there will be a rise in slurry pressure indicative of the particulates having reached said level.

11. Apparatus according to claim 10, including sleeve means outside said first passage means above said packing means adapted to be fixed against movement in the well easing, e.g. by connection to said support means, and pin and slot means interconnecting said sleeve means and said first passage means defining axial relative positions thereof including a first position in which said flow control valve means is closed and a second position in which said valve means is open.

12. Apparatus according to claim 11, said flow control valve being actuatable by motion including axial translation of the upper part of said first passage means, the lower part of said first passage means within said liner including a telescopic joint allowing axial motion of the upper portion of said first passage means without motion of said lower part of said first passage means.

13. Apparatus according to claim 10, said flow control valve being actuatable by motion including axial translation of the upper part of said first passage means, the lower part of said first passage means within said liner including a telescopic joint allowing axial motion of the upper portion of said first passage means without motion of said lower part of said first passage means.

14. Apparatus according to claim 1, 2 or 3 including fourth passage means for conducting fluid from between said liner and said first passage means to said second passage means, and flow control valve means controlling flow through said fourth passage means to said second passage means whereby when said flow control valve means is open slurry can be conducted down said first passage means and up outside the liner and clear fluid from the slurry can flow through said foraminous portion of the liner into said second passage means.

15. Apparatus according to claim 14, said flow control valve being actuatable by motion including axial translation of the upper part of said first passage means, the lower part of said first passage means within said liner including a telescopic joint allowing axial motion of the upper portion of said first passage means without motion of said lower part of said first passage means.

16. Apparatus according to claim 7 said flow control valve means further controlling flow through said third passage means.

17. Apparatus according to claim 16, including sleeve means outside said first passage means above said packing means adapted to be fixed against movement in the well casing e.g. by connection to said support means, and pin and slot means interconnecting said sleeve means and said first passage means defining axial relative positions thereof including a first position in which said flow control valve means closes off flow between said second passage means and both said third and fourth passage means, a second position in which said valve means closes off flow between said second and fourth passage means while leaving open communication between said second and third passage means, and a third position in which said valve means provides communication between said second passage means and both said third and fourth passage means.

18. Apparatus according to claim 17, said flow control valve being actuatable by motion including axial translation of the upper part of said first passage means, the lower part of said first passage means within said liner including a telescopic joint allowing axial motion of the upper portion of said first passage means without motion of said lower part of said first passage means.

19. Apparatus according to claim 14, including sleeve means outside said first passage means above said packing means adapted to be fixed against movement in the well easing, e.g. by connection to said support means, and pin and slot means interconnecting said sleeve means and said first passage means defining axial relative positions thereof including a first position in which said flow control valve means is closed and a second position in which said valve means is open.

20. Apparatus according to claim 14, said flow control valve being actuatable by motion including axial translation of the upper part of said first passage means, the lower part of said first passage means within said liner including a telescopic joint allowing axial motion of the upper portion of said first passage means without motion of said lower part of said first passage means.

21. Apparatus according to claim 1, 2 or 3 said first passage means including a receptacle adjacent to the lower part of the liner adapted to receive the lower end of the inner portion of said first passage means, which is the portion extending down inside said liner, said receptacle being releasably latched to said inner portion of said first passage means.

22. Apparatus according to claim 21, said receptacle including valve means closable to prevent back flow of material from outside the liner through said receptable portion of said first passage means when said inner portion is removed from said receptacle.

23. Apparatus according to claim 10, said flow control valve being actuatable by motion including axial translation of the upper part of said first passage means, the lower part of said first passage means within said liner including a telescopic joint allowing axial motion of the upper portion of said first passage means without motion of said lower part of said first passage means.

24. Apparatus according to claim 21, said flow control valve being actuatable by motion including axial translation of the upper part of said first passage means, the lower part of said first passage means within said liner including a telescopic joint allowing axial motion of the upper portion of said first passage means without motion of said lower part of said first passage means.

25. Apparatus according to claim 1, 2 or 3, said means supporting said liner and said packing means being movable between active and deactivated position by motion of said first passage means including rotation, said liner including rotatable means connecting the upper portion of the liner with the lower portion of the liner which lower portion includes said foraminous portion.

26. Apparatus according to claim 2 or 3, said first passage means including a telescopic joint with J-Slot and pin travel limit means limiting extension and contraction of the joint between a first position in which said valve means is open and a second position in which said valve means is closed.

27. Well apparatus for employment in a cased well bore comprising:

tubular means including a liner having a foraminous portion, means for supporting the tubular means within the cased well bore, packing means for sealing between the tubular means and cased well bore, first passage means for conducting fluent material from above said packing means down through the inside of said tubular means out of contact therewith to below said foraminous portion and thence outwardly to the exterior of the tubular means, and second passage means for conducting fluid from below said packing means inside said tubular means to above said packing means, third passage means above said foraminous portion for conducting fluid from outside said tubular means to inside said tubular means without passing through said foraminous portion, fourth passage means connecting the interior of said tubular means adjacent to said foraminous portion with the interior of said tubular means above said foraminous portion, and flow control valve means selectively positionable to in one position communicate said second and third passage means while communication between said second and fourth passage means is blocked and in another position to communicate said second passage means with both of said third and fourth passage means and in a further position to block flow to said second passage means from both said third and fourth passage means.

28. Apparatus according to claim 27, said flow control valve means including a tubular body forming part of said liner and a valve core forming part of said first passage means, said tubular body providing a seal socket adapted to receive the lower end of a string of production tubing after said first passage means is withdrawn.

29. Well completion apparatus including a production part to be left in a well bore and a tool for placing and completing the production part, said production part comprising:

a hookwall packer having a tubular packer mandrel and a seal therearound and an anchor for securing the packer in a cased well bore at a desired location, a valve barrel connected to the lower end of said mandrel having a port providing communication between the well bore and the interior of the body, a liner suspended from said valve body, said liner including a foraminous portion, and outer valve means connected to the lower end of the liner and including a receptable adapted to receive an inner valve means, said outer valve means providing a controllable flow path between the well bore and the receptacle, said tool comprising:

a tubular valve adapted for connection to the lower end of a string of tubing for providing a through flow path from the tubing through the valve to the lower end of the valve and providing a controlled transverse fluid path between the interior of the valve and a first annulus exterior of the valve inside the well casing, a dual flow passage pipe connected to the lower end of the tubular valve and including a first flow passage forming a continuation of said through flow path and a second flow passage having an upper port communicating near its upper end with said first annulus, the lower end of said dual flow passage pipe forming a valve core adapted to cooperate with said valve barrel and including a lower port communicating the lower part of said second flow passage with said valve barrel, indexing means comprising a tubular case around the upper part of said dual flow passage pipe below said upper port and pin and slot means carried one by said case and one by said dual flow passage pipe limiting axial travel of the dual pipe and case, a tubular stinger connected to the lower end of said dual flow passage pipe in communication with said first flow passage thereof, a telescopic joint connected to the lower end of said stinger, inner valve means connected to the lower end of the stinger and having an exterior adapted to be received in said receptacle, said inner valve means providing a controllable flow path between the interior of the stinger and said exterior of said inner valve means, releasable latch means carried by said receptacle and inner valve means for releasably latching said inner valve means in said receptacle, and releasable J-slot means connected to said case of the indexing means and said packer mandrel for releasably connecting said case and said packer mandrel, with the dual pipe extending through said mandrel and said stinger extending down through said liner, said valve barrel having upper and lower annular interior seals therearound above and below said port therein and said valve core having upper and lower external annular seal means therearound above and below said port therein adapted in a lower position of said core relative to said barrel to seal with said seals, and in an intermediate position of said barrel relative to said core said upper seal sealing with said upper seat and said lower seal being between said seats, and in an upper position of said core relative to said barrel both of said seals being above said port in the barrel and at least one of them sealing with said seat, said indexing means having travel limits corresponding to said upper, intermediate and lower positions of said valve core relative valve barrel.

30. A tool for use in a well completion apparatus which apparatus includes a production part to be left in a well bore and a tool for placing and completing the production part, wherein said production part comprises a hookwall packer having a tubular packer mandrel and a seal therearound and an anchor for securing the packer in a cased well bore at a desired location, a valve barrel connected to the lower end of said mandrel having a port providing communication between the well bore and the interior of the body, a liner suspended from said valve body, said liner including a foraminous portion, and outer valve means connected to the lower end of the liner and including a receptacle end of the liner and including a receptacle adapted to receive an inner valve means, said outer valve means providing a controllable flow path between the well bore and the receptacle, said tool comprising:

a tubular valve adapted for connection to the lower end of a string of tubing for providing a through flow path from the tubing through the valve to the lower end of the valve and providing a controlled transverse fluid path between the interior of the valve and a first annulus exterior of the valve inside the wall casing, a dual flow passage pipe connected to the lower end of the tubular valve and including a first flow passage forming a continuation of said through flow path and a second flow passage having an upper port communicating near its upper end with said first annulus, the lower end of said dual flow passage pipe forming a valve barrel and including a lower port communication the lower part of said second flow passage with said valve barrel, indexing means comprising a tubular case around the upper part of said dual flow passage pipe below said upper port and pin and slot means carried one by said case and one by said dual flow passage pipe limiting relative axial travel of the dual pipe and case, a tubular stinger connected to the lower end of said stinger, inner valve means connected to the lower end of the stinger and having an exterior adapted to be received in said receptacle, said inner valve means providing a controllable flow path between the interior of the stinger and said exterior of said inner valve means, releasable latch means carried by said receptacle and inner valve means for releasably latching said inner valve means in said receptacle, and releasable J-slot means connected to said core of the indexing means and said packer mandrel for releasably connecting said core and said packer mandrel, with the dual pipe extending through said mandrel and said stinger extending down through said liner, said valve barrel having upper and lower annular interior seats therearound above and below said port therein and said valve core having upper and lower external annular seal means therearound above and below said port therein adapted in a lower position of said core relative to said barrel to seal with said seals and in an intermediate position of said barrel relative to said core, said upper seal sealing with said upper seat and said lower seal being between said seats, and in an upper position of said core relative to said barrel both of said seals being above said port in the barrel and at least one of them sealing with said seat, said indexing means having travel limits corresponding to said upper, intermediate and lower positions of said valve core relative valve barrel.

31. A production part for use in well completion apparatus which apparatus includes a production part to be left in a well bore and a tool for placing and completing the production part, said production part comprising;

a hookwall packer having a tubular packer mandrel and a seal therearound and an anchor for securing the packer in a cased well bore at a desired location, a valve barrel connected to the lower end of said mandrel having a port providing communication between the well bore and the interior of the body, a liner suspended from said valve body, said liner including a foraminous portion, and outer valve means connected to the lower end of the liner and including a receptacle adapted to receive an inner valve means, said outer valve means providing a controllable flow path between the well bore and the receptacle, said production part being adapted for use with a tool comprising:

a tubular valve adapted for connection to the lower end of a string of tubing for providing a through flow path from the tubing through the valve to the lower end of the valve and providing a controlled transverse fluid path between the interior of the valve and a first annulus exterior of the valve inside the well casing, a dual flow passage pipe connected to the lower end of the tubular valve and including a first flow passage forming a continuation of said through flow path and a second flow passage having an upper port communicating near its upper end with said first annulus, the lower end of said dual flow passage pipe forming a valve core adapted to cooperate with said valve barrel and including a lower port communicating the lower part of said second flow passage with said valve barrel, indexing means comprising a tubular case around the upper part of said dual flow passage pipe below said upper port, and pin and slot means carried one by said case and one by said dual flow passage pipe limiting relative axial travel of the dual pipe case, a tubular stinger connected to the lower end of said dual flow passage pipe in communication with said first flow passage thereof, a telescopic joint connected to the lower end of said stinger, inner valve means connected to the lower end of the stinger and having an exterior adapted to be received in said receptacle, said inner valve means providing a controllable flow path between the interior of the stinger and said exterior of said inner valve means, releasable latch means carried by said receptacle and inner valve means for releasably latching said inner valve means in said receptacle, and releasable J-slot means connected to said core of the indexing means and said packer mandrel for releasably connecting said core and said packer mandrel, with the dual pipe extending through said mandrel and said stinger extending down through said liner, said valve barrel having upper and lower interior seats therearound above and below said port therein and said valve core having upper and lower external annular seal means therearound above and below said port therein adapted in a lower position of said core relative to said barrel to seal with said seals, and in an intermediate position of said barrel relative to said core said upper seal sealing with said upper seat and said lower seal being between said seats, and in an upper position of said core relative to said barrel both of said seals being above said port in the barrel and at least one of them sealing with said seat, said indexing means having travel limits corresponding to said upper, intermediate and lower positions of said valve core relative valve barrel.

* * * * *

UNITED STATES PATENT AND TRADEMARK OFFICE

CERTIFICATE OF CORRECTION

PATENT NO. : 4,440,218

DATED : APRIL 3, 1984

INVENTOR(S) : DAVID L. FARLEY

It is certified that error appears in the above—identified patent and that said Letters Patent is hereby corrected as shown below:

In the Abstract

Line 8; change "flusing" to --flushing--.

In the Drawings

Figure 6; change "109" to --79--.

Figure 7; delete "51r".

In the Claims

Claim 16, column 12, line 26; change "7" to --14--.

Claim 20, column 12, line 62; change "14" to --19--.

Claim 23, column 13, line 13; change "10" to --22--.

Signed and Sealed this

Twenty-fourth Day of July 1984

[SEAL]

Attest:

GERALD J. MOSSINGHOFF

Attesting Officer

Commissioner of Patents and Trademarks